United States Patent [19]

Boone

[11] 4,106,617

[45] Aug. 15, 1978

[54] BATHROOM FIXTURE

[76] Inventor: Philip Boone, 15 Fenwick Rd., Winchester, Mass. 01890

[21] Appl. No.: 798,465

[22] Filed: May 19, 1977

[51] Int. Cl.[2] ..... B65H 19/02

[52] U.S. Cl. ..... 206/233; 206/494; 206/812; 242/55.53; 248/201; 248/225.1; 248/225.2

[58] Field of Search ..... 312/39; 221/45; 248/201, 222.4, 223.1, 223.2, 225.1, 225.2; 242/55.3, 55.53, 55.55; 206/494, 216, 225, 233, 585, 586, 390, 409, 812, 806

[56] References Cited

U.S. PATENT DOCUMENTS

| | | | |
|---|---|---|---|
| 2,540,784 | 2/1951 | Hocher | 248/222.4 |
| 2,685,365 | 8/1954 | Sieven | 242/55.53 |
| 2,790,608 | 4/1957 | Sieven | 242/55.3 |
| 3,134,978 | 5/1964 | Arvay, Jr. | 248/201 |
| 3,563,394 | 2/1971 | Joyce | 248/222.4 |
| 3,749,296 | 7/1973 | Harrison | 206/409 |
| 3,780,908 | 12/1973 | Fitzpatrick et al. | 206/494 |
| 3,795,355 | 3/1974 | Gerstein | 206/494 |
| 3,824,953 | 7/1974 | Boone | 206/225 |
| 3,830,198 | 8/1974 | Boone | 206/225 |
| 3,921,802 | 11/1975 | Thompson | 206/390 |

*Primary Examiner*—William Price
*Assistant Examiner*—Bruce H. Bernstein

[57] ABSTRACT

A unitary multipurpose bathroom fixture of improved function and appearance for making available both conventional dry sheets of toilet-tissue from a roll carried by a spindle component and supplemental premoistened sheets from a container component. A first fastening means, exclusively serving an engaging purpose, is integral with portions supporting the spindle component. A second fastening means, also exclusively serving an engaging function, is integral with the container component. The two fastening means are adapted to effect a firm engagement with one another and thus to provide the unitary fixture. Also included are means for determining the direction of withdrawal of the premoistened sheets to insure their individual availability and to prevent dislodgement of the container. Other means relate to convenience and economy in supplying the premoistened sheets.

20 Claims, 13 Drawing Figures

BATHROOM FIXTURE

BRIEF SUMMARY OF THE INVENTION

The subject invention broadly relates to a device for meeting the inadequacy of toilet-tissue alone to perform a thorough cleansing function. It implies the need of using moistening means such as a premoistened sheet at the conclusion of the usual toilet ritual by making such sheets available directly adjacent to a conventional dispenser of toilet-tissue such as a roll thereof or a cabinet type sheet dispenser. Because of its advantages in fulfilling this need it is thought that a device of the type of the subject fixture could well supplant present inadequate dispensers and serve as a standardized means for the future.

At the present time there is believed to be but one product of a related category on the market and it is lacking in both function and appearance. Unlike the all-inclusive fixture of the present invention, it is a mere attachment for a conventional dispenser using parts of the latter which are inadequate to effect the attaching function. For example, the referenced product is so mounted by a flexible strap portion as to dangle loosely from the spindle of a toilet-tissue holder thus presenting a bizarre appearance and making correct removal of prewetted sheets while thus suspended uncertain and difficult. Such a device possesses none of the advantages of the unitary fixture of the present invention. Furthermore, the referenced product is deficient in that it makes cumbersome the replacing of an exhausted roll of toilet-tissue or an exhausted supply of prewetted sheets as the two procedures cannot be performed independently of one another. The subject bathroom fixture permits complete independence of these two operations.

In the light of the foregoing deficiencies of the product now on the market, the fixture of the present invention is believed to distinguish completely therefrom and to possess marked advantages as follows. It is an integral unit for making available both conventional dry toilet-tissue and supplemental premoistened sheets. It provides control of the withdrawal of the premoistened sheets so as to enable their ready separation and to avoid any dislodgement of the container component in which they are supplied. It permits replenishing the supply of toilet-tissue and premoistened sheet material independently of one another. It is a fixture of neat appearance suitable for inclusion in a well-ordered bathroom.

In view of the foregoing considerations, objects of the invention are to provide an improved bathroom fixture for making available in a single unit both conventional toilet-tissue and premoistened sheets for supplemental use therewith; to provide a fixture of the character described which possesses advantages of pleasing appearance and moderate cost; to provide such a bathroom fixture which permits independent mounting and supply of the dry and premoistened sheet materials; and to provide a device as characterized which is of simple, trouble-free construction. Other objects of the invention will in part be obvious and will in part appear hereinafter.

BRIEF DESCRIPTION OF THE DRAWING

The novel features which are believed to be characteristic of the invention are set forth with particularity in the appended claims. The invention, however, both as to its organization and its method of operation will best be understood from the following description when read in connection with the accompanying drawing wherein like numbers have been employed in the different figures to denote the same parts and wherein:

DETAILED DESCRIPTION

Figure 1:
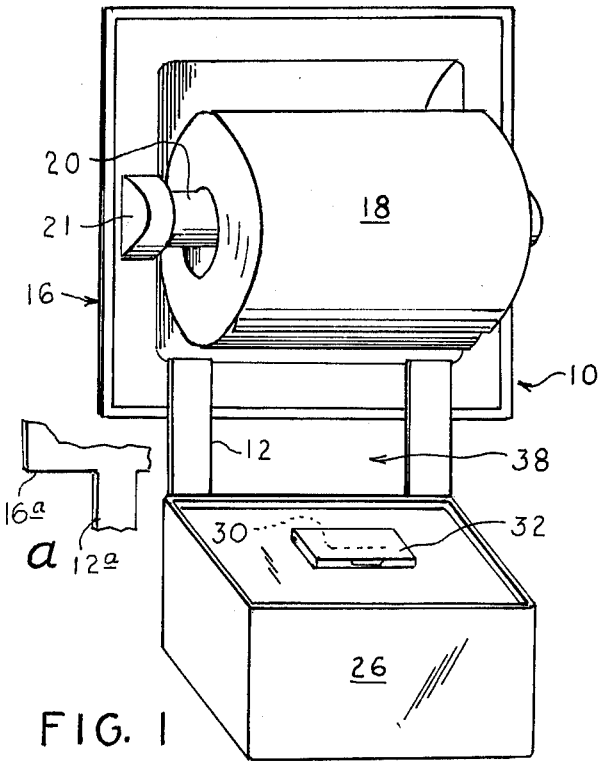
FIG. 1 is a diagrammatic perspective view of the roll-holding and premoistened sheet supply bathroom fixture.

In FIG. 1 there is illustrated one form of the bathroom fixture 10 of the invention. Each of the depending arms 12 includes a forwardly-projecting stud 14 (FIG. 2), the thus-laterally-spaced pair of studs constituting a first fastening means adapted to cooperate with a second fastening means, described below. The arms 12 are integral with the principal body or support portion 16 of the fixture. A roll of conventional toilet-tissue is carried on a spindle 20, the latter being mounted in post members 21 which are unitary with the portion 16.

Figure 12:
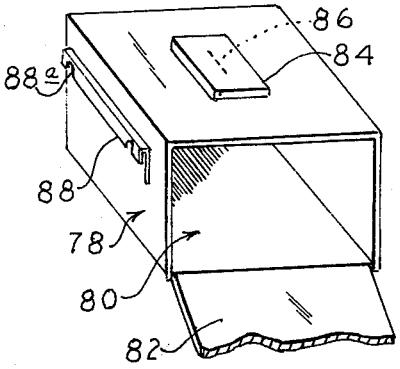
FIGS. 12 and 13 are diagrammatic perspective views, partially broken away, illustrating a container component and a packaged supply of premoistened sheet material for insertion therein. While fastening means for complementary use with fastening means of portions of the fixture which mount the spindle are illustrated, the container may be inseparably attached to the latter portions.
Figure 6:
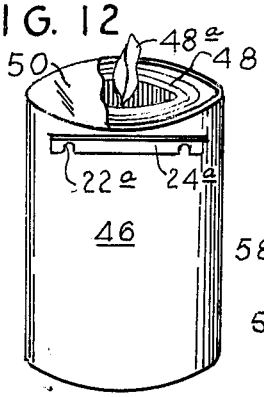
FIG. 6 is a diagrammatic rear view of a container releasably holding a continuous coiled supply of premoistened sheet material. The cover is broken away to show withdrawal from the inside of the coil through a slit (not shown). Individual sheets are separated when semiperforations are drawn to adjacency with the slit, the material being drawn angularly so as to bear against a side of the slit. The slit may be of the form shown in FIGS. 1 and 12 or of another functionally suitable conformation.

The second fastening means comprises means forming a pair of laterally-spaced slots 22, the means being an overturned bar 24 unitary with the container 26 and the slots being formed in the bar, as additionally shown in FIGS. 6 and 12. An alternate construction is represented by the tongue-and-groove means of FIG. 4. It is to be noted that engagement and disengagement of the fastening means is achieved through manual movement of the container in a vertical direction. Identification of the studs (or tongue) with the arms 12 or other means unitary with the principal support 16 and the slot means 24 with the container component 26 is a preferred construction but could be reversed.

Figure 5:
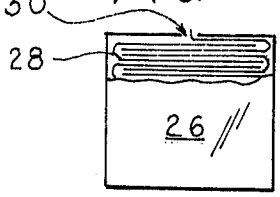
FIG. 5 is a diagrammatic side view partially broken away of interleaved premoistened sheets releasably held in a container.

As above described, the container 26 is held firmly in fixed relation to the spindle 20 bearing the toilet-tissue 18 to form the complete bathroom fixture. Within the container is a supply of premoistened sheets exemplified by the interleaved sheets 28 of FIG. 5. The sheets are impregnated with a liquid, e.g., an aqueous liquid such as water and alcohol and possibly including an emollient. The container is substantially air-tight. An aperture 30 of given characteristics is provided for withdrawal of the sheets. A pivotal cap 32 covering the aperture is shown in FIG. 1 and in subsequent figures but is intentionally omitted in FIGS. 2 and 5 to better illustrate the withdrawal operation. To properly unfold an individual sheet or separate semi-perforated sheet sections of a continuous length of sheet material an angular direction of withdrawal is generally preferable or essential. Assuming some little force to be necessary in effecting the withdrawal it is conceivable that a dislodgement of the container 26 might occur were the direction of withdrawal to be vertical. A further reason for withdrawing the sheet material angularly thus exists.

Figure 2:
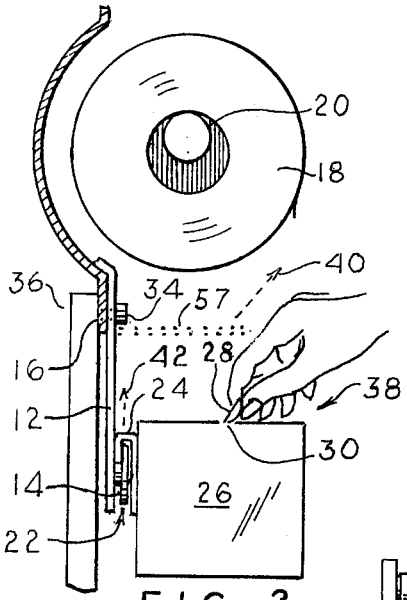
FIG. 2 is a side elevation view of the fixture of FIG. 1 particularly illustrating the controlled angle of removal of a premoistened sheet.

In FIG. 1 the arms 12 are to be assumed as bonded to the principal support portion 16 as by welding, an epoxy resin or by rivet or screw means 34 (FIG. 2). Or, as in FIG. 1*a*, the body portion and arms may be stamped out from a single sheet as represented by members 12*a* and 16*a*. The fixture is attached to the bathroom wall in a conventional manner. While the example is recessed therein, it could, of course, be of a flush-mounted type which would position the spindle and roll of toilet-tissue more directly over the container aperture or additionally recessed to reduce outward projection of the container.

As indicated in FIGS. 1 and 2, a semi-enclosed area 38 is provided by the relative locations of the container 26, the spindle 20 and the mounted roll 18, in conjunction with the wall 36. These locations are predetermined to provide a semi-enclosed area of such dimensions as to restrict the entrance of the user's hand to grasp the leading portion 28 of the premoistened sheet material and insure its angular withdrawal as indicated by the arrow 40. As illustrated, this angle differs from the upward direction of disengagement of the fastening means 14 and 24 indicated by the arrow 42 so that no dislodgement of the container can occur during sheet withdrawal. The relation of angular withdrawal to sheet unfolding and separation has been stated above.

The container 26, studs 14, bar or flange 24 and 44, frame 60 and modified forms thereof may suitably be formed of a plastic composition such as polypropylene or ABS or of a metal. The support 16 and arms 12 may appropriately be formed of or of some combination of a metal, a plastic or a ceramic material.

Figure 3:
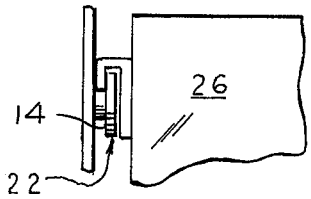
FIGS. 3 and 4 are fragmentary side views of means for releasably fastening together the container of premoistened sheets and portions integral with means for mounting the roll of toilet-tissue.
Figure 4:
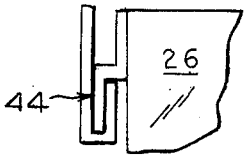

FIGS. 3 and 4 further illustrate stud-slot and tongue-and-groove constructions.

In FIG. 6 there is illustrated a circular container 46 embodying fastening means similar to that of FIGS. 2 and 3, namely, the bar 24*a* having slots 22*a* formed therein and adapted to engage studs of the type above-described. Assuming the bar 24*a* to be lengthened and the slots 22*a* to be more widely spaced, the container can be mounted on the arms and studs of FIGS. 1 and 2 to constitute the bathroom fixture. A continuous length of premoistened sheet material 48 having transverse spaced semiperforations at given intervals is coiled within the container. A leading portion 48*a* is drawn from the inside of the roll through a slit-like aperture, not shown but to be understood as extending in a direction from left to right in the cover 50, that is, parallel to the bar 24*a*. Individual sheets are torn off adjacent to the aperture.

Figure 7:
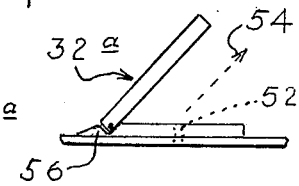
FIG. 7 is a diagrammatic side view of closure means overlying the exit aperture or slit which also serves to control the angle of withdrawal of premoistened sheet material.

FIG. 7 illustrates a modification 32*a* of the pivotal cap 32 which serves also as an alternative or additional means for controlling an angular withdrawal of the premoistened sheet material through an aperture at 52, as indicated by the directional arrow 54. The limit stop protuberance 56 determines the degree to which cap 32*a* can open. The cap thus provides an obstacle to withdrawal of the sheet in a direction other than that indicated. A short horizontal plate 5(FIG. 2) could be added to further restrict insertion of the fingers to withdraw the sheet, the plate projecting from arms 12.

Figure 8:
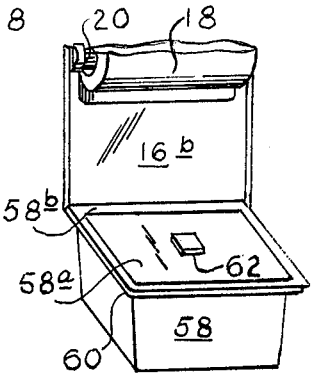
FIG. 8 is a diagrammatic perspective view of a container releasably mounted in a frame-like structure, the latter being unitary with portions mounting a roll of toilet-tissue. The container releasably holds a supply of premoistend sheets.

In FIG. 8 there is shown a modification of means for releasably mounting a container component 58 within a frame-like member 60 to constitute a different version of the fixture. A unitary downward plate-like extension 16*b* of the support portions 16 (FIGS. 1 and 2) supplants the pair of arms 12, to illustrate a possible and preferred alternative for positioning the container 58 of premoistened sheets at the proper functional distance below the spindle 20 and roll of toilet-tissue 18 to provide the desired withdrawal angle, above-described. It will be understood that an aperture for the purpose underlies the cap 62. The container includes an airtight cover portion 58*a*.

Figure 10:
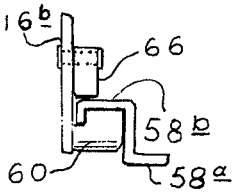
FIGS. 9 and 10 are fragmentary side views of fastening means for holding the container component of FIG. 8 firmly mounted in the frame-like mounting member thereof.
Figure 9:
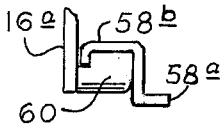

Means for mounting the container component 58 in the frame-like member 60 are shown in detail in FIGS. 9 and 10. An overhanging marginal area 58*b* of the cover portion 58*a* engages the frame-like member 60. In FIG. 10 a pivotal locking element 66 is shown as an additional optional means for holding the container against displacement. The frame-like member could be pivotally attached to portion 16*b* permitting it to be pivoted downwardly to the fixed horizontal position shown and to be pivoted downwardly to the fixed horizontal position shown and to be folded upwardly against the latter for shipping convenience.

Figure 11:
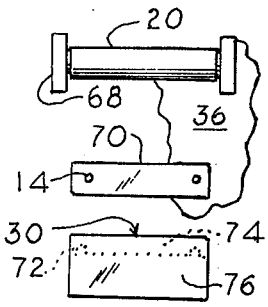
FIG. 11 is a diagrammatic front elevation view of the fixture adapted to separate mounting posts for the spindle wherein a predetermined spacing of the spindle and container components is maintained to enable the angular withdrawal of premoistened sheet material illustrated in FIG. 2.

A modification wherein the spindle 20 is mounted between two supporting posts 68 is shown in FIG. 11. A pair of laterally-spaced studs 14 project from a plate 70 attached to the wall 36 on which the posts are mounted and constitute a first fastening means. Slots 72 are formed in the bar 74 integral with the far side of the container component 76. The plate 70 is so positioned with respect to the spindle 20 that when the slots 72 engage the studs 14 and the container 76 is thus mounted, a correct spacing between the latter and the spindle 20 is established. Assuming a roll of toilet-tissue to be mounted on the spindle, a desired minimum distance is provided between the spindle (or roll) for insertion of the hand and withdrawal of a premoistened sheet from the aperture at 30 at an acute angle in the manner and for the purpose described above. Alternatively, the posts 68 may be mounted on a single plate-like support.

Figure 13:
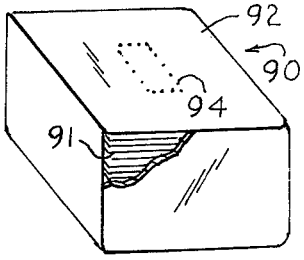

FIGS. 12 and 13 illustrate pre-packaging of the moistened sheets in a disposable sheath. The sheath is adapted to insertion in a permanent type of container component which may or may not be permanently mounted on the downwardly extending supporting portions of the fixture which are integral with those portions mounting the spindle. This construction distinguishes from those previously described wherein a throw-away type of container component of the fixture when exhausted of its content may be removed and replaced by one fully loaded. A container component 78 includes an aperture 80 closed by pivotal closure means 82. An openable cap 84 overlies a slit-like aperture 86. Although, as above stated, the container may or may not be fixedly mounted on support portions of the fixture, it is shown with fastening means for releasably mounting it, the choice being optional. Advantages of a removable permanent type of container relate to its ease of cleansing and loading with the moistening material. If, however, the container is to be inseparably mounted, such means as rivets, bolts, welding, etc. may be employed for the purpose. A fastening means 88 includes the slots 88*a*. In either case the container is to be considered a permanent component.

A package 90 containing a plurality of premoistened sheets 91 is shown in FIG. 13. It comprises a hermetic sheath 92 formed, for example, of a suitable plastic material such as polyethylene, a waxed paper or cardboard, an aluminum foil or the like. A tear-out aperture is provided at 94. When aperture 94 has been excised, the package is adapted to be inserted through aperture 80 into the container component 78 of FIG. 12, the excised area 94 being thus aligned with aperture 86 and a leading edge of an uppermost sheet 91 being drawn through the latter aperture as by means, not shown, suitable to the purpose. The premoistened sheet material may be interleaved or otherwise formed whereby withdrawal of a leading portion automatically draws the next succeeding portion through the aperture 86. In this regard, the container may be of the form shown in FIG. 6 and a prepackaged roll of sheet material inserted therein, an openable cover being provided for the purpose. A prepackaging of the premoistened sheets in an inexpensive throwaway sheath for insertion in a permanent container component may, it is thought, have overall cost advantages.

The container 78 may be assumed to provide an airtight enclosure for the sheets once the area 94 of the package 90 has been removed. Any suitable means may be employed to impel a plurality of premoistened sheets stacked in a container upwardly toward an exit aperture. A simple pressure-plate interposed between the bottom sheet and the container base is one possibility. Any other means suitable to the purpose may be employed.

No special means is seen to be necessary to urge a continuous length of sheet material upwardly where leading portions of successive sheets are automatically caused to protrude through an exit aperture of the container component. The container components of FIGS. 1, 2, 8 and 12 and the sheath of FIG. 13 may be considered as adapted to supply a continuous length of premoistened sheet material as well as individual sheets thereof. Such a continuous length could, for example, be one having transverse semi-perforations at given intervals and successive lengths folded back and forth on one another.

Where individual sheets are interleaved or otherwise folded, the container exit aperture, although indicated of slit form, may be of a considerable non-binding breadth permitting leading portions of the sheet to be lifted toward withdrawal in a generally vertical direction. To this end, one side of the aperture may have a slight platform portion adjacent thereto whereby the sheet in being drawn across the platform is first drawn vertically through the aperture and may subsequently be withdrawn angularly. A locking means such as means 66 of FIG. 10 may be employed where any vertical force which might tend to dislodge the container component is involved.

Assuming the container aperture to be in the form of a slit and adapted to use of a continuous length of sheet material, a cutting edge thereof may be included, e.g., one of a metallic saw-toothed structure. Again, a pair of crossed slits may be employed.

While specific examples of the fastening means have been described herein and may be considered as preferred constructions, it is desired not to be limited thereto as other means for a generally similar purpose may be employed.

In reviewing the structures described herein, it is to be stressed that the bathroom (toilet) fixture of the invention is of itself a complete, integrated, multifunctional unit of novel construction and performance. As such, it distinguishes from a conventional dispenser of toilet-tissue and a mere attachment therefor of uncertain stability and operation.

It will be understood that the subject invention may be practiced or embodied in other ways without departing from the character or spirit thereof. The preferred embodiment described herein is to be regarded, therefore, as illustrative and not restrictive, the scope thereof being indicated by the appended claims and all variations which come within the meaning of the claims are intended to be embraced therein.

I claim:

1. A multifunctional bathroom fixture for mounting on a vertical wall, said fixture comprising:

a vertically-disposed first support means adapted to be mounted on said wall, said first support means including means to receive a spindle and a supply of dry toilet-tissue;

a second support means including at least one downwardly extending substantially flat member, said member having its flattened portion parallel to the wall, the upper portion of said member being connected to a lower surface of said first support means;

first fastening means at the lower end of said member, said fastening means being disposed in a plane substantially perpendicular to the flat surface of the member;

a container releasably holding a supply of moistening material, said container including means in a wall thereof forming an aperture through which said material can be withdrawn;

control means to determine the direction of withdrawal of said material; and second fastening means integral with said container at a surface facing said second support means, said second fastening means including a portion complementary to said first fastening means to enable the container to be fastened thereto.

2. A fixture as defined in claim 1 wherein said downwardly extending member is in the form of arm means.

3. A fixture as defined in claim 1 wherein one of said first and second fastening means is a pair of laterally spaced studs and the other is a pair of similarly laterally spaced slots.

4. A fixture as defined in claim 1 wherein said fastening means are essentially of a tongue-and-groove type.

5. A fixture as defined in claim 1 wherein said control means is a semichamber formed by a combination of said spindle, said support means and said container which limit the direction of manual withdrawal of said moistening material.

6. A fixture as defined in claim 1 wherein said first and second fastening means are disengageable to permit removal of said container.

7. A fixture as defined in claim 1 wherein said container is of a rectangular configuration and adapted to the supply at its aperture of individual sheets from a continuous length of said moistening material carried within said container.

8. A fixture as defined in claim 1 wherein said container is of a circular configuration and adapted to the supply at its aperture of individual sheets from a continuous length of said moistening material releasably coiled within said container.

9. A fixture as defined in claim 1 wherein said moistening material is prepackaged in a disposable sheath, wherein said container has an aperture adapted to accept the sheathed material, and wherein said container includes closure means for said aperture.

10. A fixture as defined in claim 9 wherein said sheath includes an exciseable section which , when removed, is adapted to alignment with the aperture of said container.

11. A fixture as defined in claim 1 wherein said first fastening means comprises a frame-like member attached to said second support means and said second fastening means comprises an overhanging portion of said container which is adapted to rest upon and engage said frame-like member when said container is mounted therein.

12. A fixture as defined in claim 11 wherein is included means for locking said container at mounted position.

13. A fixture as defined in claim 1 wherein said first and second fastening means are at least functionally inseparable and, accordingly, wherein said container is permanently fastened to said second support means.

14. A fixture as defined in claim 13 wherein said fastening means includes a permanent bondsuch as a weld or the like.

15. A fixture as defined in claim 1 wherein portions thereof are adapted to recessing in one or more openings in said bathroom wall.

16. A fixture as defined in claim 1 wherein said container aperture includes pivotal cap-like closure means which at an acutely angular open position influences the direction at which manual withdrawal of said moistening material can be accomplished.

17. A fixture as defined in claim 1 wherein said first support means and said member of the second support means are coplanar and of one piece.

18. A fixture as defined in claim 1 wherein said member of the second support means is in the form of a sigle rigid plate-like element.

19. A fixture as defined in claim 1 wherein said fastening means is a pair of mating male and female components carried by contiguous surfaces of said container and said member of the second support means.

20. A fixture as defined in claim 1 wherein portions of said member of the second support means and the container mounted thereon may be recessed in said wall.

* * * * *